United States Patent [19]

Bockemühl-Simon et al.

[11] Patent Number: 4,586,805

[45] Date of Patent: May 6, 1986

[54] DEVICE FOR DEVELOPING OF PHOTO MATERIAL

[75] Inventors: Johannes J. Bockemühl-Simon; Rainer Bernhardt; Walter Kremer, all of Bergneustadt, Fed. Rep. of Germany

[73] Assignee: JOBO Labortechnik GmbH & Co. KG, Gummersbach, Fed. Rep. of Germany

[21] Appl. No.: 290,807

[22] PCT Filed: Jun. 23, 1981

[86] PCT No.: PCT/EP81/00080

§ 371 Date: Aug. 3, 1981

§ 102(e) Date: Aug. 3, 1981

[30] Foreign Application Priority Data

Jun. 26, 1980 [DE] Fed. Rep. of Germany ..... 3023953
Sep. 13, 1980 [DE] Fed. Rep. of Germany ..... 3034673

[51] Int. Cl.[4] ..... G03D 3/02; G03D 13/04

[52] U.S. Cl. ..... 354/323; 354/324; 354/330

[58] Field of Search ..... 354/299, 324, 329, 330, 354/323

[56] References Cited

U.S. PATENT DOCUMENTS

| | | | |
|---|---|---|---|
| 3,377,938 | 4/1968 | Patterson | 354/299 |
| 3,508,483 | 4/1970 | Weider et al. | 354/324 |
| 3,623,416 | 11/1971 | Anderberg | 354/324 |
| 3,868,715 | 2/1975 | Slavin | 354/324 |
| 4,248,514 | 2/1981 | Watkins | 354/330 |
| 4,350,429 | 9/1982 | Slavin | 354/324 |

FOREIGN PATENT DOCUMENTS

| | | | |
|---|---|---|---|
| 847547 | 7/1949 | Fed. Rep. of Germany | 354/324 |
| 1303749 | 9/1972 | Fed. Rep. of Germany . | |
| 1466524 | 12/1966 | France | 354/324 |
| 1473351 | 3/1967 | France . | |
| 1093348 | 11/1967 | United Kingdom . | |

*Primary Examiner*—A. A. Mathews
*Attorney, Agent, or Firm*—Michael J. Striker

[57] ABSTRACT

In a device for developing of photo material in a treatment container (11) a plurality of supply containers (20) for different treatment liquids (22) are provided which are controlled with gas pressure by a gas line (57) connected thereto. In this case the treatment liquid (22) is fed through an associated feed pipe (56) into a collection line (34). This is defined by a distributor valve (70) in accordance with a control program. In order to develop reliable and simple devices, the flow paths (56,34,42) of the treatment liquid (22) from the different supply containers (22) to the treatment container (11) should be free of valves and the distributor valve should only be admitted by the gas, whereby the controlled outlet of the distributor valve is relieved from the gas pressure (58) at the end of an operating phase. A sensor (59) reacts on the flow of the treatment liquid and actuates a timer which after a certain time period again switches the distributor valve.

18 Claims, 12 Drawing Figures

Figure 1:
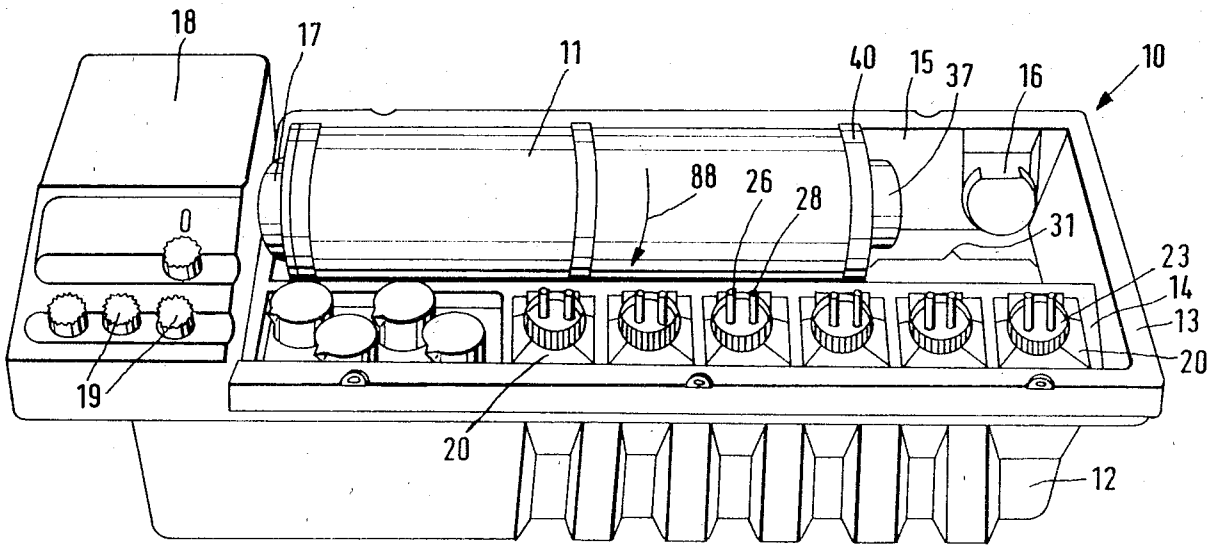

FIG.9
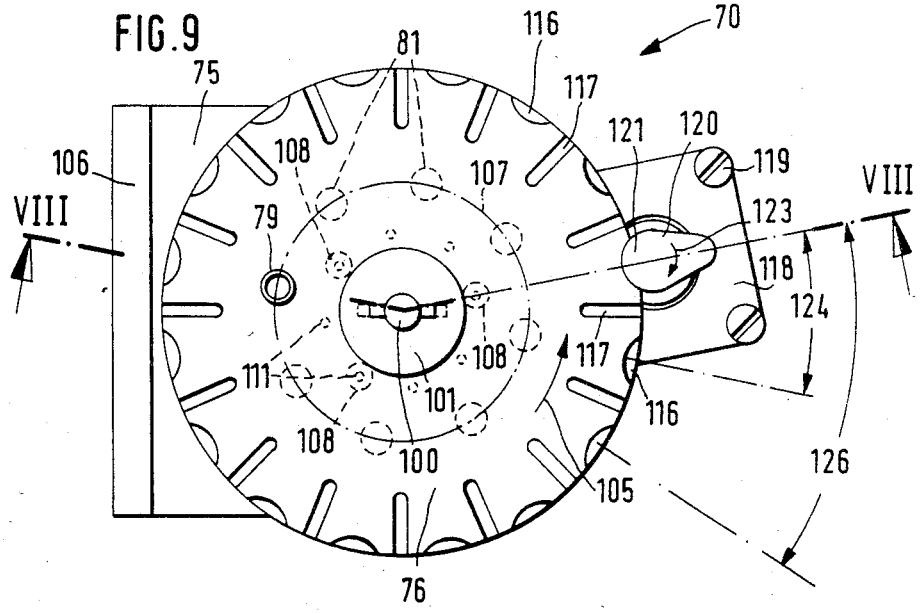
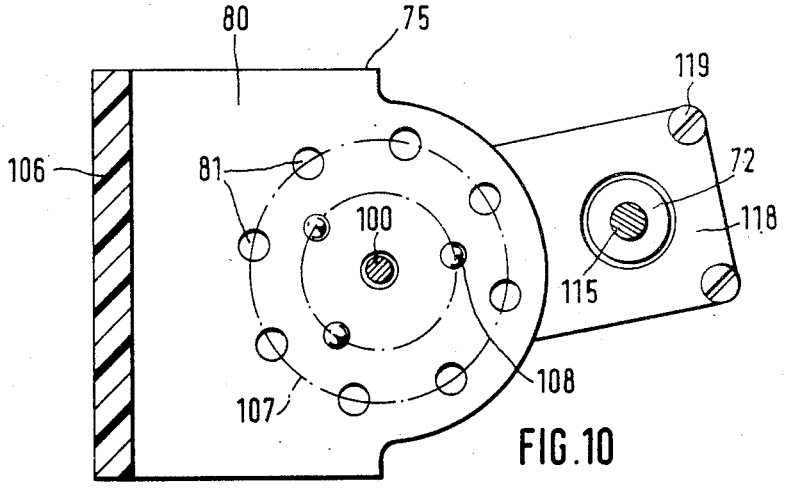
FIG.10

DEVICE FOR DEVELOPING OF PHOTO MATERIAL

The invention is directed to a device for developing of photo material in a treatment container. For storing the different treatment liquids a number of closed supply containers and provided which, on the one hand, are provided with a gas line and, on the other hand with a feed pipe for the treatment liquid, because in this manner the development process of photo material may be automated for the amateur photographer, in contrast to the expensive devices which operate with feeding pumps (DE AS No. 11 06 178).

At times the gas line is connected to a gas supply source and thereby builds up a gas pressure within the container which drives the treatment liquid from this supply container through the feed pipe. The feed pipes which come from the various supply containers, as well as an additional valve controlled rinse water line are connected to the treatment container through a collection line, whereby the photomaterial is contained in the treatment container for developing. A control program determines the sequence of the consecutive operating phases in which a given treatment liquid is fed from one of the supply containers into the treatment container, which is performed by a distributor valve which is switched by a step motor in accordance with a control program.

In the known device of this type (DE-AS No. 13 03 749), the distribution valve does not only control the gas to the right supply container, but also the treatment liquid from the controlled supply container into the collection line. For this purpose, the distributor valve has a very complicated structure which is subjected to breakdowns. In addition to an inlet for the gas supply line which is connected to the gas supply source in accordance with the control program, and which is connnected to one of the outlets at one of the supply containers which support the gas lines, the distributor valve contains a plurality of further inlets for connecting the feed pipes which come from each of the supply containers and which in accordance with the control program are coupled to a joint outlet, so as to guide the corresponding treatment liquid to the collection line. Even if rinsing with water is performed between the operating steps with different treatment liquids, the danger of contamination of the treatment liquid by previous liquid residues exists since in particular the sealing means in the distributor valve will fail, after a longer operating period. The supply line for the gas may be closed by the control program through a closing valve, however the gas lines and thereby the feed pipe remain under pressure at their connecting locations on the distributor valve, whereby minute leaks could already cause grave mutual contaminations of the treatment liquids.

Finally, in the known device a closing valve is required at the end of the collection line which in accordance with the program permits the flow of the desired quantity of treatment liquid into the treatment container. The treatment liquids used for the developing process are aggressive which requires high quality material for the closing valve and the aforementioned distributor valve. Furthermore, the treatment liquids form crusts which impair the actuation of the valves and impair the seals. In order to reduce interferences on the valves, they must be precisely made, which renders the known devices very expensive and not affordable for a photo amateur.

It is therefore an object of the invention to develop an economical and breakdown free device of the type mentioned in the preamble of the claim 1 which permits a completely automatic rapid change of the different treatment liquids without the danger of liquid loss or contaminations.

This object of the invention is obtained in that the flow paths for the different treatment liquids which extend from one of the supply containers to the treatment container are free of valves and have a defined flow resistance, that the distributor valve is admitted by gas only through one inlet for the gas supply source, like a compressed air pump, as well as through outlets for the gas lines of the different supply containers. At the end of one operating phase before a reverse switching of the distributor valve to a different outlet, the previously controlled outlet of the gas distributor valve being relieved from the gas pressure. A sensor is provided in the collection line which reacts on the flow of the treatment liquid, and that the sensor activates a timer at the beginning of each operating phase which, after an adjusted time period, switches the step motor of the distributor valve in accordance with the control program.

In the invention a valve is eliminated which may come into contact with the treatment liquid, whereby a structural part is saved which would be susceptible to trouble. The distributor valve coacts with gases only, like compressed air, so that impurities cannot occur. An uncontrollable leakage of the treatment liquids from a feed pipe is safely avoided, because at the end of an operating phase, before the distributor valve is reversed, the outlet of the distributor valve which was previously controlled is relieved from the gas pressure. This renders the gas line free of pressure and the column in the feed pipe which extends to the treatment liquid can flow back into its supply container and would be available for a further use again. This safely eliminates an undesired flow back of treatment liquid into the collection line. This is particularly true when the connecting pieces of the different feed pipes, which extend into the collection line, are deflected and form an end shank extending into the direction of gravity, so that the treatment liquid can flow back from the deflected location into the associated supply container, in this case.

The relieve of the gas pressure at the outlet of the distribution valve for the aforementioned purpose can be performed in two ways, each of which have their advantages. It is particularly effective to establish a gas vacuum pressure for a short time at the inlet of the distributor valve at the end of an operating phase which is carried out in that the inlet is reversed from a pressure source of the gas to a suction source, for example. Thereby, it suffices to perform a reverse control from the pressure end to a suction end of an air pump, whereby the use of a two way valve at the inlet of the distributor valve is sufficient. The vacuum at the inlet is self-propagating as a relieve of the gas pressure to the given controlled outlet of the distributor valve. Due to the vacuum a suction is exerted on the associated liquid column in the feed pipe, whereby this liquid is quickly returned. Due to the gas which is pulled, any eventual retained droplets in the feed pipe are also pulled along, so that an uncontrollable afterflow of liquid is not to be feared.

A simpler method for relieving the gas pressure at the end of an operating phase consists of that the controlled outlet of the distributor valve is connected for a short time with the atmosphere, whereby the gas pressure collapses. Thereby, it is particularly important that supply containers are used which are pneumatically deformable in themselves, due to the exerted gas pressure. For this purpose, simple plastic bottles are suitable. Such plastic bottles are voluminously blown up by the gas pressure in the operating phase. When the gas pressure collapses due to the connection with the atmosphere, the liquid column which now flows back into the associated supply container obviously has an inertia effect which due to the incompressibility of the liquid has a desire to flow beyond the pressure balance and thereby surprisingly exerting a suction effect which takes care of the aforementioned closing of the feed pipe, thus safely eliminating undesired afterflow of the treatment liquid. In this case, even a suction source may be eliminated.

Although no valves are used in the area of the liquid flow, an exact dosaging of the treatment liquid flowing from the collection line into the treatment container is obtained. The mentioned sensor in the collection line reacts at the start of the flow and activates a timer which after the adjusted time period causes the step motor for a further switching of the distributor valve. Because the flow resistances in the flow paths of the different treatment liquids are definitely designed which in short feed pipes is achieved by adding of resistor means, for example. The same quantities flow at the same time periods. Thereby, by means of a timer one obtains an exact dosaging of the fed through quantities of the given required treatment liquid, in a simple manner.

A very simple connection of the outlet of the distributor valve with the atmosphere at the end of an operating phase is obtained by lifting the rotational movable part of the distributor valve from its stationary part for a short time. It is advantageous to use a plate for the rotationally movable part as well as for the stationary part of the distributor valve which is made easily rotatable by intermediary balls. The balls are engaged in the oppositely directed front faces of the two plates in recesses which determine the given rotating position of the distributor valve in the given operating phase and thereby align the bores which serve for transferring the pressure medium from the inlet to the chosen outlet of the distributor valve. In addition, the balls fullfill a third task in that they generate the desired axial stroke between the two plates, while in the intermediary positions which are present in the given operating phases the balls move out of their recesses in the rotational movable plate and axially shift the plate against a spring load. During this lifting a sealing ring at the connection piece of the inlet bore for the pressure medium lifts from the stationary plate, thus lifting the prviously controlled outlet against the atmosphere. Due to this lifting, the sealing ring at the connecting piece at the inlet bore is protected which provides a long lifespan to the seal. It is particularly simple to provide a connecting piece freely rotatable in the inlet bore of the one plate, for example, rotationally movable plate for the supply line coming from a compressed air pump, for example, however this presents an expensive and trouble prone axial feeding of the compressed air. In the other plate, for example, the stationary plate counter bores are provided which form the outlets for the different gas lines which are in alignment with the rotationally movable connecting piece.

Figure 2:
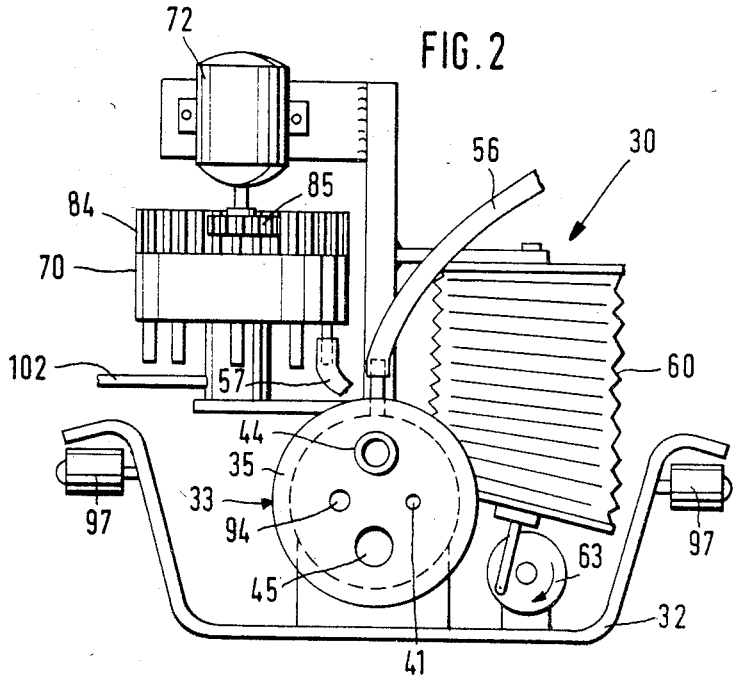
Figure 3:
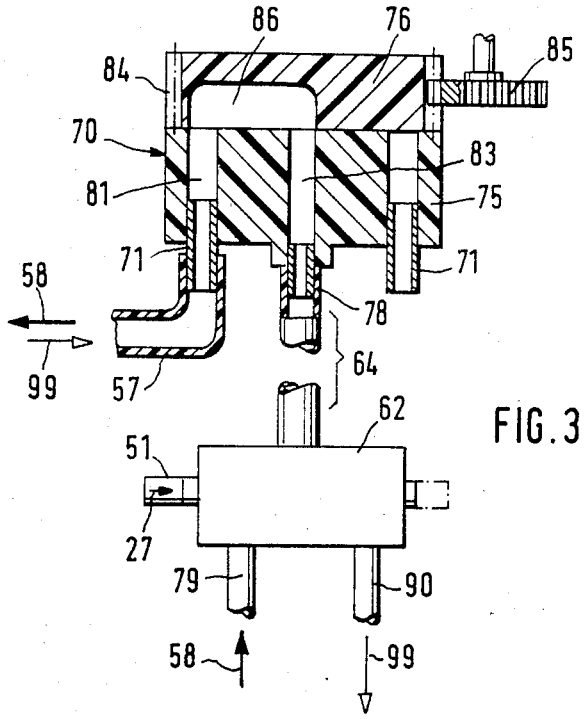
Figure 4:
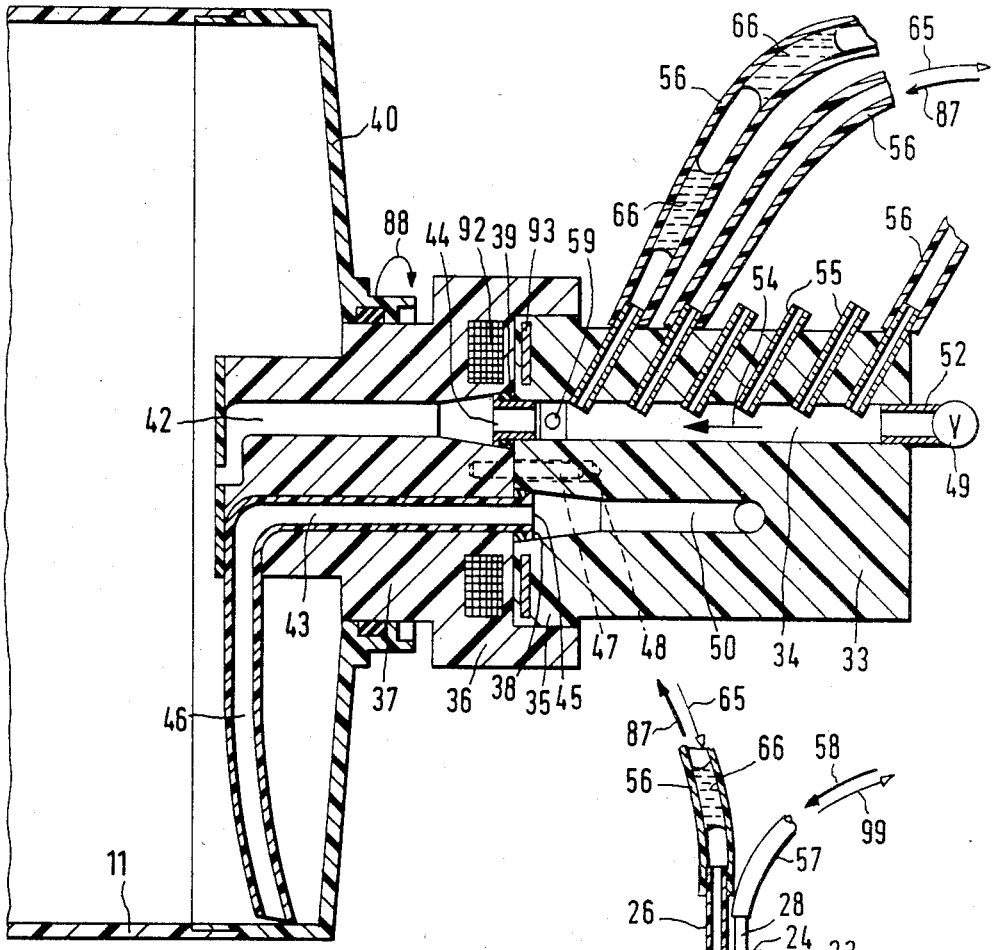

Further advantages and measures of the invention are mentioned in the claims, the drawngs and in the following description. The drawings show a plurality of exemplified embdiments of the invention. The drawings show:

FIG. 1 a suitable processor to be used in the inventive device for developing of photo material, FIG. 2 an end view of the device used with the processor of FIG. 1 schematically showing the most important structural elements, whereby a cover lid of the device has been omitted, FIG. 3 structural elements belonging to the device of FIG. 2 namely, a distribution valve in a sectional view, as well as a reverse switch provided in front of the distribution valve, FIG. 4 a longitudinal sectional view through an essential partial piece of the device, wherein a rotating drum is used as the treatment container in the processor of FIG. 1.

Figure 5:
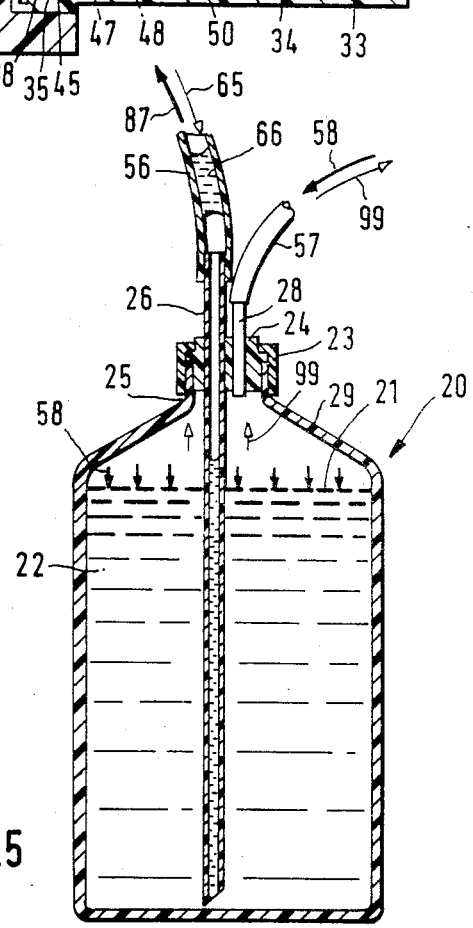
Figure 7:
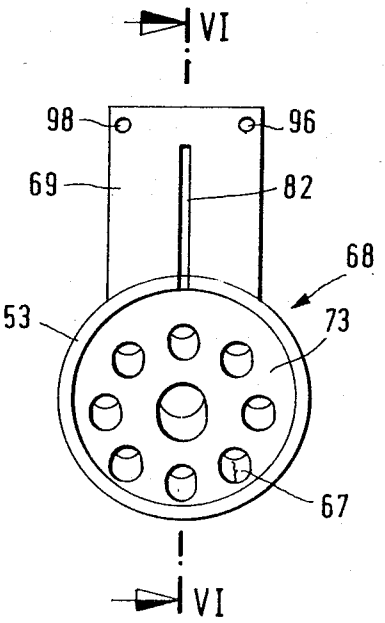
Figure 6B:
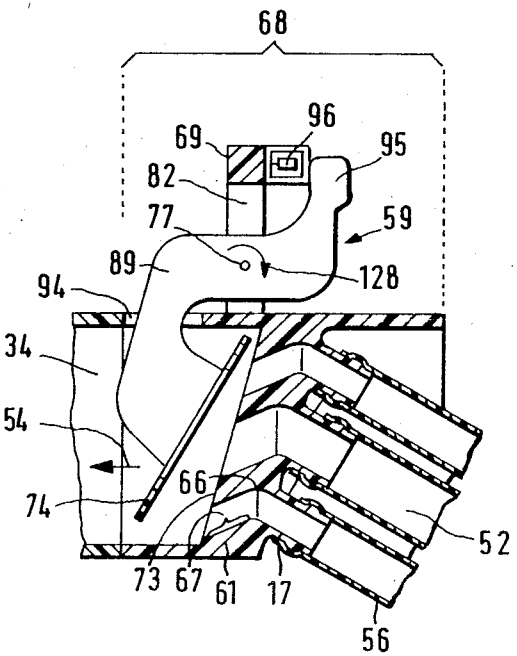
Figure 6A:
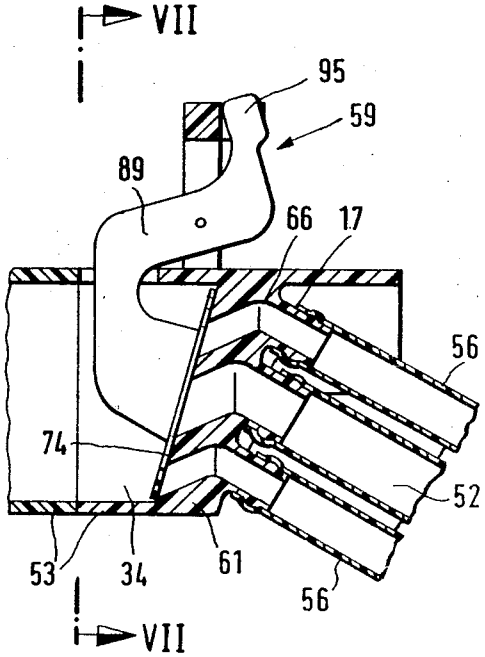
Figure 8A:
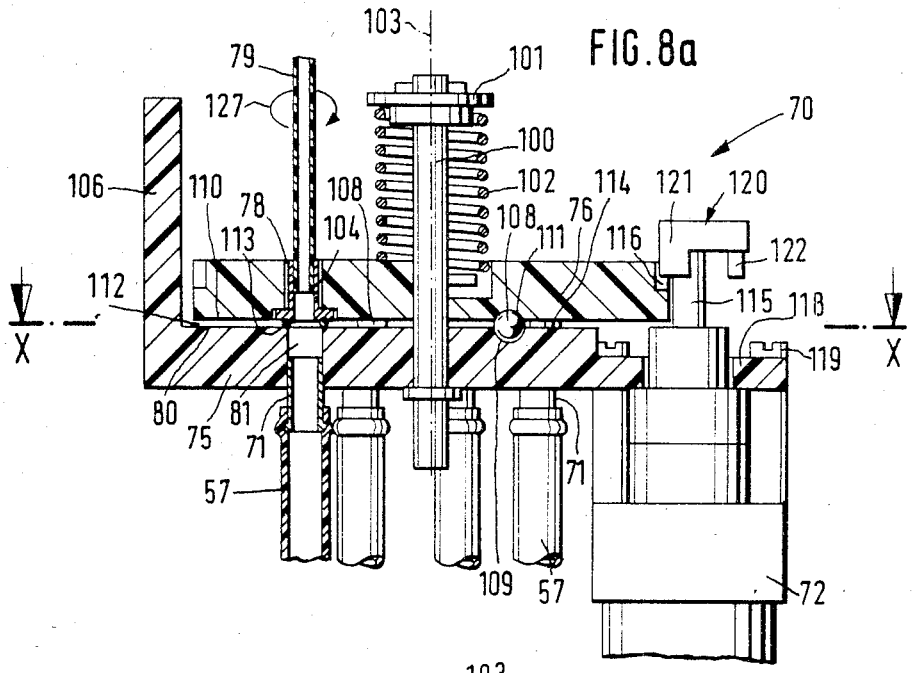
Figure 8B:
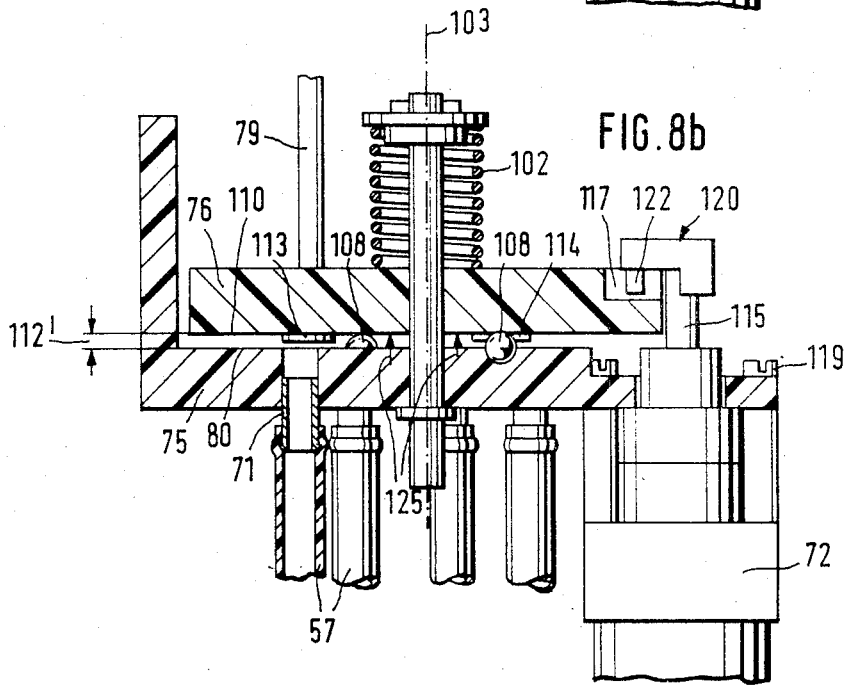

FIG. 5 a longitudinal sectional view through a supply container for the treatment liquid which is mounted in a recess of processor shown in FIG. 1 and immerses into a tempering bath therein, FIG. 6*a* and 6*b* the longitudinal view through the beginning piece of a collection line of the inventive device in two operating positions, whereby the longitudinal sectional line is shown through the intersectional line VI—VI of FIG. 7, FIG. 7 an end view through the detached beginning piece of the collecting line, whereby a pivotably movable structural element is serving as a sensor for the liquid has been omitted for clarification purposes, FIG. 8 and 8*b* the longitudinal view in a section through a distributor valve used in the inventive device in two different operating positions with respect to each other, whereby the sectional view for FIG. 8*a* is recognizable by the sectional line VIII—VIII of FIG. 9, FIG. 9 the plan view of the distributor valve in the operating position of FIG. 8*a* and, FIG. 10 the plan view of the stationary part of the distributor valve with a sectional view through the axis, whereby the sectional line X—X is shown in FIG. 8*a*.

The processor 10 shown in FIG. 1 permits an automatic development of photo material which is placed into the inside of a drum 11. During operation, the drum 11 is driveable along arrow 88. The required motors and pumps are mounted in a control housing 18 of processor 10 which circulates a tempering bath which is maintained at a defined temperature. The tempering bath is contained in a lower receptacle 12 of processor 10 and is fed by the pumps into an upper conduit 15 where drum 11 is located. The tempering bath flows from the conduit through an overflow 16 back into receptacle 12. The motors and pumps, as well as the temperature of the tempering bath are adjustable by different handles 19 on control housing 18.

The receptacle 12 is covered to the outside with a suitable profiled cover 13 and has a series of openings 14 in which a plurality of supply containers 20 are mounted with different treatment liquids which immerse into the tempering bath. Bottles made out of plastic material are used as supply containers 20 which are deformable in themselves and which are usually provided with screw caps for transporting the liquid. These screw caps are removed in the device for being used as supply containers 20 and are provided with particular connections, as is best shown in FIG. 5.

The connections consist of an insert 24 which is mounted in the opening of the container neck 25 and is mounted by a screw cap 23 at the neck 25 of container 20. A feed pipe 26 is extended through insert 24 at which a feed pipe 56 for the treatment liquid 22 in container 20 is provided. Furthermore, the end of supply line 28 of a gas line is guided through insert 24 through which, in the subject case, compressed air is fed into the inside of the container above the liquid level 21. The supply containers 20 are retained in a desired immersion depth in the tempering bath of receptacle 12 by means of suitable supports which engage shoulders 29 of container 20, as can be seen in FIG. 5.

The essential structural units of the inventive device 30 are shown in FIGS. 2 to 4. The device is mounted on a housing portion 32 which may be mounted in the free space 31 adjacent to drum 11 as can be seen in FIG. 1, and which is movable by means of running rollers 97 on side portions of conduit 15 of processor 10. The device 30 is provided with a connection element 33 which is connected to the inside of the drum 11 by a suitable coupling. In the subject case, this is carried out by a lid 40 which is detachable from drum 11 which is provided with a sealed central insert 37 which does not rotate during the drum rotation 88. The insert 37 is provided with a socket 36 wherein the end 35 of the connecting element 33 is plugged in and is maintained in a liquid tight manner by the two halves 92,93 of a magnetic coupling, for example.

The insert 37 is provided with a plurality of openings one of which is a vent opening which leads from the inner space of the tank to the outside and which in the coupling position extends into a vent channel 41 of connecting element 33, as can be seen from the end view of FIG. 2. Furthermore, the insert 34 is provided with a supply conduit 42 and a discharge conduit 43 for the treatment liquids which on the inside of the drum extends with a lifting pipe 46 to the bottom of the drum. In the coupling position these supply and discharge conduits are connected by means of seals 38,39 with openings 44,45 in the connecting element, whereby the opening 44 is associated with a collecting line 34 and opening 45 is associated with a discharge conduit 50 in connection element 33. The mentioned venting channel 41 could be closed at times by shut off elements, now shown, whereby an excess or vacuum pressure may be obtained within the drum for determined control operations. A plug in connection is provided for a rotational resistant positioning of the plug end 35 of connecting element 33 in the socket 36 of the drum side of the insert 37, which in this case consists of a mandrel 47, on the one hand, and a mandrel receiver 48, on the other hand.

As can be seen from FIG. 4, the collection line 34 extends concentric in the connection element 33 and is provided at its free end with a line 52 for the rinse water which is closable by a valve 49. The rinse water flows through the collection line 34 in longitudinal firection and flows through the connected supply channel 42 into the inside of the drum for watering the photo material. With respect to the flow direction in the collection line 34 indicated by arrow 54 connecting cannulas 55 for the already mentioned feed pipes 56 of the different supply containers 20 discharge in an acute angle laterally into the collection line 34. Advantageously, the connecting cannulas 55 are disposed in a vertical plane, so as to at least provide one component to be effective in the direction of gravity. The flow of a defined treatment liquid 22 is obtained when, as shown in FIG. 5, compressed air is fed into the inside of the container through the mentioned gas line 57 and is active on the liquid level 21, as shown by the arrows 58 in FIG. 5. Thereby, the treatment liquid 22 is pushed upwardly in feed pipe 26 and is fed through the feed pipe 56 and the associated connected cannula 55 into the collection line 34. The treatment liquid 22 does not flow through any valve in this flow path 26,56. The flow resistance in this flow path 26,56 has a defined dimension which may be kept at the desired value by installations. The time period of the liquid flow defines the quantity of the treatment liquid 22, because the active pressure 58 and the flow resistance in the supply containers are constant. Thus, this quantity is defined by the time period in which a pressure 58 is exerted within the container. This is automatically controlled by a distributor valve 70, whereby the drawings show to exemplified embodiments namely, FIGS. 2 and 3, on the one hand and in FIGS. 8*a* to 10, on the other hand.

The mode or operation and the basic structure of the distributor valve 70 will be explained in conjunction with FIGS. 2 and 3. The distributor valve 70 is admitted by gas only whereby in the subject case compressed air 58 is used which is fed from a pump through a supply line 79 and, in accordance with FIG. 3, through a reverse switch 62 and a connecting line 64 to the only inlet 78 of the distributor valve 70. The distributor valve 70 consists of a stationary part 75 and a rotationally movable part 76 which is driven by a step motor 72, for example, by means of a pinion 85 and a circumferential gear 84. In the subject case, the compressed air inlet 78 is disposed centrally in the stationary part 75 and discharges into an axial inlet opening 83. The rotational movable part 76 is provided with a rotational chamber 86 which connects the inlet opening 83, in dependency from the given rotating position of the rotational movable part 76, with an outlet 71 and an associated outlet opening 81. The different outlets 71 are mounted on a circle in the stationary part 75 coaxially with respect to the inlet opening 83 and serve to connect the individual gas lines 57 which lead to the different supply containers 20.

The compressed air pressure consumption for driving out the treatment liquid 22 in a supply container is not measured because different liquid quantities would result due to the deformations of the flexible supply containers in light of the prevailing inner pressure and the different height of the liquid level 21 in supply container 20. The time period of the mentioned flow 54 in the collection line 34 in front of drum 11 is measured, which is scanned by a sensor 59 indicated in FIG. 4. The sensor 59 reacts to a flow of the liquid. It can consist of an electrical resistor, for example, a grounded conductor which reacts to the presence of liquid. One could also use optical devices, for example, a light bar which is formed on both sides of the collecting line 34 between a light transmitter and a light receiver. As an optical sensor one could also use the refraction of a light beam in the flowing liquid. In FIGS. 6*a* to 7, a mechanical active sensor is shown which at a later time will be explained in detail with respect to its mode of operation and its structure. The sensor 59 is in its rest position as long as no liquid is present in the collection line 34. In this case, it is reported to an electronic control device through electrical connections, not shown, on sensor 59 that no treatment liquid flows to the drum.

When the distributor valve 70 is so adjusted through a control program of the control device that a determined supply container 20 is supplied with compressed air 58 and thereby the corresponding treatment liquid 22 flows into the collectin line 34 through its associated feed pipe 56 and its connecting cannula 55, the sensor 59 reports to the control device the start of the liquid flow. Thereby, a timer is actuated in the control device which is adjusted for a defined time period. When this time period is expired, a switch pulse is triggered in this control device which interrupts the supply of compressed air 58 to this supply container 20, whereby the flow of the given treatment liquid 22, which is indicated by arrows 87 in FIGS. 4 and 5, ends in feed pipe 56. Advantageously, the corresponding supply container 20 is also relieved from the pressure 58 prevailing therein which is simply carried out in that the associated outlet 71 is connected with the atmosphere for a short time. Thereby, the compressed air flows back, as indicated by the arrows 99 in FIG. 5, through the associated gas line 57. This can be carried out by a reverse switching of the distributor valve 70 when the adjusted time in the associated timer is expired, which is initiated by the mentioned electronic control device. Thereby, a control pulse is fed to the step motor 72 which moves the rotationally movable part 76 of the distributor valve 70 through the mentioned drive connection 84,85. Thereby, not only the supply of the air pressure 58 is interrupted, but also the pressure 58 within the bottle is reduced in accordance with the arrows 99 in FIG. 5. For this purpose FIGS. 8*a* to 10 shows a particularly simple and reliable embodiment which will be described in more detail at a later time.

When the supply containers 20 are flexible, for example, made out of plastic material which are somewhat blown up by the inner compressed pressure 58, a surprising suction effect is obtained during the mentioned return flow 99 of the compressed air from the supply container. Due to the return flow of the treatment liquid in accordance with the return flow arrow 65, shown in FIGS. 4 and 5, in the feed pipe 56 which had been active, inertia forces are obviously active which generate a suction effect on the inside of the container 20. Thereby, any liquid residues 66 are pulled along in the feed pipes 56. Thereby, the feed pipe 56 is safely emtied and an uncontrolled afterflow of these liquid residues 66 are eliminated during a later different operating phase of the device.

For this purpose, a particular suction phase at the end of each operating phase is provided which is triggered by the mentioned timer by a control pulse in the embodiment of FIG. 3. The embodiment of FIG. 3 is particularly suitable for particularly rigid supply containers 20 which are not deformable on account of the alternating inner pressure 58. For this purpose, the reverse switch 62 is used which is designed as a two way valve. In addition to the already mentioned supply line 79, the reverse switch 62 also supports a suction line 90 which leads to an air suction source. The given switch position of the reverse switch 62 is activated by a slide 51, or the like. In the drawn out switch position of the slide 51, as shown in FIG. 3, the supply line 79 is connected with the inlet line 78 of the distributor valve 70 through the connection line 64, which is the reason that the mentioned operating phase of the device is present, whereby the corresponding treatment liquid 22 is driven out of the associated supply container 20 and is fed into the drum 11, in accordance with the flow arrow 87 of FIGS. 4 and 5. At the end of the operating phase, which is defined by the adjustment of the effective time period of the mentioned timer, slide 51 of the reverse switch 62 is transferred into the other switch position indicated by the dash -dot lines in FIG. 3, whereby at this point the suction line 90 is connected with the inlet 78 of the distribution valve 70 through connection line 64. If need be, slide 51 could remain in an intermediate position, whereby the supply line 79 for the compressed air, as well as the suction line 90 are shut off, thus creating a connection of the inlet 78 from the distributor valve 70 with the atmosphere, for example. If the slide 51 is in the dash-dot switch position of actuating arrow 27 of FIG. 3, which is actuated by the control device, the suction 99, as can be seen from FIG. 5, is active through the gas line 57 on the inside of the previously active container 22. Thereby, the associated feed pipe 56 is thoroughly rinsed from the remaining mentioned liquid residues 66.

Further rotated by the step motor 72, the rotationally movable part 76 of the distributor valve 70 remains at first in an ineffective intermediary position wherein none of the outlets 71 are supplied with compressed air. Now, the development process of the photo material can take place within the drum by the mentioned rotation 88 of drum 11. The associated time period is determined by the mentioned control program and is controlled by the control devices. After the treatment process for the photo material with the corresponding treatment liquid, the drum 11 is emptied. This may be done, for example, by tilting the drum 11, whereby the liquid runs out of the drum by itself. In the exemplified embodiment of FIG. 2, a pump 60 is provided for this purpose which is driven by a motor 63. Thereby, the corresponding treatment liquid is suctioned off in the connecting element 33 by the lifting pipe 46, the discharge conduit 43 and the discharge conduit 50 connected thereto and can, if need be, collected in a separate container, not shown, for regeneration purposes.

During such an intermediary position of the distributor valve 70, the rinsing process may also take place within the drum. For this purpose, the shut off valve 49, shown in FIG. 4, is opened by the control device in accordance with a chosen program, whereby water runs from the rinse water line 52 into the collection line 34 and is fed from there through the supply channel 42 into the inside of the drum. After the rinsing process, the water is removed from drum 11 in the already aforementioned manner, either by gravity in that the drum is tilted, or by pumping it out with pump 60, the lifting pipe 46, the discharge channel 43 and the discharge channel 50.

Thereafter the device 30 is ready to introduce the next treatment liquid 22. This is programmed in the control program. The step motor 42 brings the rotationally movable part 76 of the distributor valve 70 into a rotating position, whereby the inlet 78 is connected with a defined outlet 71 of the distributor valve 70 through its radial chamber 86. Thereby, compressed air 59 again flows into the associated supply container 20 and drives the desired treatment liquid 22 in flow direction 87 through the associated feed pipe 56. Thereby, the process is repeated. It is to be understood that in a structure in accordance with FIG. 3, the reverse switch 62 has been again reversed to the supply line 79 for compressed air 58.

As already repeatedly mentioned, the FIGS. 6*a* to 7 show a different embodiment of the sensor which has been extremely successful. For a clearer understanding the same structural units are provided with the same numeral references as used in the aforgoing exemplified embodiment, even if the structure is differently designed therefrom. This exemplified embodiment is particularly suitable for a tilt movable drum to facilitate emptying. The outpouring of the tank contents by means of tilting through the opening of the tank is in this case also used for introducing the fresh treatment liquids. Therefore, the collection line 34, shown in FIGS. 6*a* to 7, discharges into this drum opening. Here, the collection line 34 is formed by a pipe 53 and does not require a connection element 33 of exemplified embodiment of FIGS. 2 to 4 with different openings. Therefore, pipe 53 may have a cross section which is comparable to the cross section of connecting element 33. For the purpose of a good run off for the liquid pipe 53 is disposed with a slight incline with respect to the drum axis, whereby the liquid can run into the drum by means of gravity. At the beginning of the collection line 34, pipe 53 is provided with an end plate 61 which is provided with connecting pieces 17 for the different feed pipes 56, as well as for the rinse water line 52. The connecting pieces form an angled line path which reaches its highest position at a deflected point 66 and extends from there with an end shank 67 in a downward gravity direction. This is advantageous in that with respect to this deflected point 66, the liquid quantuties behind this point always flow through the end shank 67 into collection line 34 and from there into the inside of the drum, while the liquid residues in front of this deflected angle flow back in the feed pipe 56 and to the associated supply container 20, in accordance with the mentioned return flow arrow 65, after the completion of the operating phase, as has been already extensively explained.

The end piece 68 of pipe 53 together with the end plate 61 and the different connecting pieces 17, as well as a radial flap 69 are advantageously made from one piece of plastic material. The inner front face end piece 68 is shown in FIG. 7. The inner face of end plate 61 forms an abutment face 73 for a flap 74 associated with this sensor 59. In the subject case, the abutment face 73 extends slightly inclined with respect to the longitudinal direction of the collection line 34. As can be seen from FIG. 7, the different connecting pieces 65 with openings discharge into the abutment face 73, that is, the opening of the connecting piece for the rinse water line 52 is disposed at about the center of the pipe and is surrounded by a circle of openings which belong to the connecting pieces 17 of the different feed pipes 56.

In this case, the sensor 59 comprises an S-shaped offset two arm lever 89 which extends through a slot 82 in the mentioned radial flap 69 and is provided with a pivot axis 77. The lever 89 is introduced into the collection line 34 through an upper disposed slot 34 in the end piece 68 of pipe 53 and the mentioned flap 74 is mounted on the inner arm end. On account of the weight of flap 74, the lever 89 has a tendency to engage the abutment face 73 together with the flap which may be enhanced by a return spring if need be. Such a rest position is shown in FIG. 6*a*. The outwardly directed free arm 95 at this point is at a position with the mentioned radial flap 69 crossing a light bar. A light transmitter 96 and a light receiver 98 are disposed at each side of the movement path of this lever arm 95 which is defined by slot 82, as can be seen from FIG. 7.

When liquid flows through the feed pipes 56 in the direction of the collection pipe 34, the liquid engages flap 74 and moves 128 lever 89 around its pivot axis 77. This establishes the operating position of the sensor, in accordance with FIG. 6*b*. The free arm 95 is pivoted out of the way and releases the light bar, whereby the light can move without any interference from the transmitter 96 to the receiver 98. This takes place as soon as the treatment liquid starts flowing into the collection pipe 34. The released light bar 96,98 activates a timer which is adjusted to a defined time period. After the time period has expired, as already mentioned before, a control pulse is fed to the step motor of the distributor valve 70.

A particular simple and reliable structure of the distributor valve is shown in FIGS. 8*a* to 10, whereby the same structural elements are provided with the same reference numerals as used heretofore in the description. The stationary and rotationally movable part 75,76 consist in this case of a plate each which are connected with each other by an axial bolt 100 and are pushed against each other by a pressure spring 102 which supports on an disk 101 at the end of the axial bolt.

In the subject case, the compressed air inlet 78 is disposed in the rotationally movable plate 76 and consists of an inlet bore disposed in a radial distance to the rotational axis 103 of the two plates 75,76, whereby a connecting piece 104 for the supply line 79 is disposed in the inlet bore. The connecting piece 104 is rotatably 127 mounted in the inlet bore 78, so that during the rotational movement 105 of plate 76, the connecting piece 104 can completely rotate and does not twist supply line 79, as can be seen from FIG. 9. The stationary plate 75 is mounted in the device by a flange 106 and is provided with a plurality of bores which are disposed on a circle 107 in conformity with inlet bore 78 and which have outlets 71 for connecting the different gas lines 57. FIG. 10 shows a plan view of the stationary plate 75 on the upper front face 80 of which the outlet opening 81 of the mentioned outlets 71 are provided on the dash-dot indicated circle 107. Between the two plates 75 and 76, bulbs 108 are provided for bearing purposes which are disposed at the sides of the stationary plate 75 in deep recesses 109 and on the opposite lower front face 110 of the rotationally movable plate 76 in flat recesses 111. Between these two front faces 80,110 of the two plates 75,76, a small slot 112 is maintained on account of the support by the intermediary positioned balls 108, as already shown in the initial position of FIG. 8*a*.

This slot 112 is gas tight bridged by a sealing ring 113 which is rigidly mounted on the connecting piece 104 which is disposed at the inlet side and encompasses the discharge opening thereof. In the inclined position of FIG. 8*a*, the sealing ring 113 is in adjustment with the defined outlet 71 of a gas line 57 and supplies the associated supply containers 20 with air pressure, as already described before. In this case, the sealing ring 113 is compressed between the two front faces 80,110 of the two plates 75,76. For stabilizing the rotationally movable plate 76, the plate is provided with support rings 114 of a corresponding height in addition to the sealing ring 113 which together provide a slot 112 of even height. The initial position of FIG. 8*a* is always present during an operating phase of the device where on account of the rotating portion of the rotationally movable plate 76 a defined outlet 71 is controlled.

This rotational portion is at first retained in that the three balls 108 are engaged in associated recesses 111, the disposition of which is shown in dotted lines in the plan view of FIG. 9. While only three deep recesses 109 are provided for mounting the balls in the stationary plate 75, a plurality of flat recesses 111 are provided in the stationary plate in a defined angular position corresponding to the number of outlet openings 81. The balls 108 and their recesses 111 together with the mentioned pressure spring 102 acts as a kind of a locking connection. However, the decisive retention of the rotating position of the rotationally moveable plate 76 is defined by a rotating member 120 which is mounted on a drive shaft 115 of the step motor 72. The motor 72 is mounted on an offset plate extension 118 by means of screws 119, or the like. The circular-like circumference of the rotationally movable plate 76 is provided with two types of recesses 116,117 which are disposed in an alternating manner with respect to each other and have to fulfill different functions with respect to each other. In the initial position of FIG. 8*a* and 9, a rear piece 121 of the rotating member 120 engages in one of recesses 116, thus fixing the rotating position of plate 76. This is the reason why this recess is called a rest recess 116. When the step motor 72 is driven for executing a switch step, the rear piece 121 which is provided with a rotating profile rolls off from the rest recess 116 which is defined by a corresponding circular profile untill a radially offset switch finger 122 of the rotating member 120 reaches the next recess 117 during the rotation 123 indicated in FIG. 9, and pulls the rotationally mounted plate 76 in its rotational direction 105 by an angular magnitude 124, as can be seen from FIG. 9. In light of this transport, the recess 117 can be designated as a transport recess. After rotation around this angular magnitude 124, the following rest recess 116 comes to rest in the area of the rotating member 120 which is the reason that its rear end 121 engage therewith, so that this new rotation position of the rotationally movable plate 76 can be fixed. As can be seen, the recesses 116,117 cooperate with rotating member 120, like a so-called "Maltese cross drive".

FIG. 8*b* shows the reverse control phase of the distributor valve 70, whereby the switch finger 122 engages into a transport recess 117, thus moving the rotationally movable plate 76 forward. Thereby, ball 108 disengages from the flat recess 111 of the rotationally movable plate 76, as can be seen in FIGS. 8*a* and 9. The balls rolls in front of the lower front face 110 of the rotationally movable plate 76, whereby plate 76 is lifted against the action of a pressure spring 102, in accordance with the stroke arrows 125 shown in FIG. 8*b*. The hitherto narrow slot 112 between the plate front faces 110,80 in the initial position of FIG. 8*a* is enlarged to a wide gap 112' shown in FIG. 8*b*. During this lifting 125 of the rotationally movable plate 76, the sealing ring 113 which serves to seal the compressed air is naturally also lifted, whereby the previous controlled outlet 71 is vented. Thereby, the aforementioned reduction of pressure is obtained in the associated gas line 57 and in the supply bottle 20, as indicated by the arrows 99 in conjunction with FIG. 5 which effects an immediate backflow 65 of the treatment liquid from the associated feed pipe 56. The further flow of the liquid treatment medium is immediately interrupted and it does not matter whether the compressed air pump which is connected to the supply line 79 is switched off, or whether a shut off valve is closed at the compressed air source.

The lifting 125 of plate 76 during its rotation 105 also protects the sealing ring 113, as well as the support rings 114. The balls 108 generate a roller bearing for plate 76 which therefore can be easily adjusted.

After each switching step of step motor 72 by the angular dimension 124, as shown in FIG. 9, the step motor 72 can be switched off. This is determined by a control program which follows in its individual phases the desired process of the development process inside of drum 11 of FIG. 1. After the rotational movement 105 by the angular magnitude 124, as shown in FIG. 9, plate 76 has been moved by only half a switching position wherein the supply line 79 is not yet in alignment with the next outlet opening 81. Therefore, the supply line 79 is positioned between two outlet openings 81 and cannot become effective. Since the recess 11 on the lower front face 110 of plate 76 are not aligned with balls 108, the lifted 125 condition shown in FIG. 8*b* remains. At this point, the treatment liquid can be active on the photo material for the desired time period inside of drum 11. Thereafter, the liquid is pumped out. If need be, rinsing with water can take place. Only when all this had been performed, the step motor 72 will be actuated again for a short time, whereby its rotating member 120 moves the plate 76 by a further angular dimension 124 which moves the plate 76 around the lateral angle 126 with respect to the initial position of FIG. 9. At this point the supply line 79 is in alignment with the next outlet opening 81 of the stationary plate 75. The ball 108 is now also in alignment with the next recess 111 on the lower side 110 of the plate and engages therein. Thereby, plate 76 is again pushed downwardly by the spring force and then the sealing ring 113 is pressed between the front faces 80,110 of the two plates, thus sealing the transfer between the plates 75,76. Now, compressed air can flow to the next controlled outlet 71 when the control program wants to transfer the associated treatment liquid 22 of the controlled supply container 20 into the inside of the drum. Thereby, the already mentioned process is repeated. If the transfer of the treatment liquid is not desired, the compressed air pump will not be switched on or the shut off valve between the compressed air source and the supply line 79 is not opened, so that the step motor 72 can perform the further switching into the next position.

It is to be understood that instead of compressed air any other given gases may be used as a pressure medium, for example, nitrogen which would come from a given source, for example, a gas bottle.

We claim:

1. A device for developing of a photo material, comprising a treatment container; a gas supply source; a plurality of closed supply containers for different treatment liquids, each of said supply containers being provided with a gas line which is connectable with said gas supply source and thereby builds up a gas pressure within a respective one of said supply containers, each of said supply containers being also provided with a feed pipe for a treatment liquid which is driven from a respective one of said supply containers by the gas pressure which feeds a desired quantity of the treatment liquid to said treatment container; means forming a plurality of paths for the different treatment liquids extending from a respective one of said supply containers to said treatment container, said means including a collection pipe through which the desired quantity of the treatment liquid is fed by the gas pressure from respective one of said supply containers to said treatment container, said means also including a plurality of feed pipes connected with said supply containers; a distribution valve having a plurality of inlets and outlets and a step motor which switches said distribution valve in accordance with a control program so as to provide connections to the respective inlets and outlets of said valve and to thereby feed a respective treatment liquid from a respective one of said supply containers into said treatment container during respective operating phases in accordance with the control programs, said flow paths for the different treatment liquids being formed so that they are free of valves and have a defined flow resistance, said distribution valve being arranged so that it is loaded with gas only through one of said inlets for said gas supply source as well as through said outlets for said gas lines of said supply containers, and at the end of one of said operating phases for a reverse switching of said distribution valve to a different one of said outlets the previously controlled one of said outlets is relieved from the gas pressure; and a sensor provided in said collection line and reacting to a flow of the treatment liquid, and a timer activated by said sensor at the beginning of each of said operating phases and after an adjusted time period switching said step motor of said distributor valve in accordance with the control program.

2. A device as defined in claim 1; and further comprising a valve-controlled rinse water line connected with said collection line.

3. A device as defined in claim 1, wherein said gas supply source is formed as a compressed air pump.

4. A device as defined in claim 1, wherein said distribution valve is formed so that at the end of each of said operating phases a vacuum is present for short time at said inlet of said distribution valve.

5. A device as defined in claim 1, wherein said gas supply source is formed as a compressed air source; and further comprising an air suction source, and a two-way valve connected with said inlet of said distribution valve, said two-way valve having one end connected with said compressed air source, and another end connected with said air suction source.

6. A device as defined in claim 5; and further comprising an air pump having a pressure end which forms said compressed air source and a suction end which forms said air suction source.

7. A device as defined in claim 1, wherein said distribution valve is formed so that when reversing said distribution valve between two operating phases, the previously controlled one of said outlets for using the gas pressure in an associated one of said gas lines is connectable with the atmosphere for a short time.

8. A device as defined in claim 1, wherein said distribution valve has a stationary part having a seal therebetween and power stressed with one another, said rotation movable part being axially detachable from said stationary part against a pressure load during the reversing of said distribution valve so as to provide a connection of the previously controlled one of said gas lines with the atmosphere.

9. A device as defined in claim 1, wherein said supply containers are pneumatically deformable under the action of the gas pressure in them.

10. A device as defined in claim 9, wherein said supply containers are formed as deformable synthetic plastic bottles.

11. A device as defined in claim 8, wherein said rotational movable part is formed as a plate having an axis of rotation and an inlet bore which is disposed at a radial distance from said axis of rotation, said gas supply source having a supply line, said plate of said rotational movable part having a connecting piece for said supply line and being freely rotatable, said connecting piece having an outlet opening provided with a sealing ring which faces said stationary part, said stationary part being formed as a plate with a plurality of counter bores arranged at a radial distance corresponding to the radial distance of said inlet bore so as to form outlets for connecting said gas lines.

12. A device as defined in claim 11, wherein said plate of said rotational movable part is spring biased and rotatably mounted on said plate of said stationary part by means of intermediate balls, said plates having opposite front faces provided with recesses for said balls which in said operating phases are aligned in pairs with respect to each other, but do not conform with each other during the reverse switching so as to generate an axial stroke of said plate of said rotational movable part with respect to said plate of said stationary part and to thereby lift said connecting piece from said plate of said stationary part.

13. A device as defined in claim 11, wherein said step motor has a rotary member provided with a radial switch finger and a rear piece, said plate of said rotational movable part having a circular circumferential edge provided with two types of recesses which alternate with each other, said recesses including rest recesses for a rotational engagement of said rear piece of said rotary member during the operational phase of said distribution valve, and transport recesses for entering said switch finger for controlling said distribution valve over a predetermined rotary angle.

14. A device as defined in claim 1, wherein said sensor is arranged in said collection line and formed as a light barrier.

15. A device as defined in claim 1, wherein said sensor is formed as an electrical resistor.

16. A device as defined in claim 1; and further comprising an abutment associated with said collection line, said sensor being formed as a flap which is movable in a flow direction and which in its rest position is pushed against said abutment by reverse forces thereby closing a throughflow crosssection of said collection line, said flap at the start of a liquid flow being movable away from said abutment thus releasing the throughflow cross-section of said collection line.

17. A device as defined in claim 1, wherein said sensor includes a light barrier, said flap being pivotable and provided with an arm which at the start of pivoting of said flap crosses said light barrier.

18. A device as defined in claim 1, wherein said feed pipes are provided with connecting pieces which extend into said collection line and are deflected, each of said connecting pieces being provided with an end shank which extends downwardly in the direction of gravity.

* * * * *